US007344086B2

(12) United States Patent
Grossman et al.

(10) Patent No.: US 7,344,086 B2
(45) Date of Patent: Mar. 18, 2008

(54) ANTI-THEFT LOTTERY TICKET AND METHODS

(76) Inventors: Harry Jay Grossman, 3181 Orangetree Bend, Fort Myers, FL (US) 33905; Elie D. Ribacoff, 184-03 69th Ave., Fresh Meadows, NY (US) 11365

( * ) Notice: Subject to any disclaimer, the term of this patent is extended or adjusted under 35 U.S.C. 154(b) by 0 days.

(21) Appl. No.: 11/413,556

(22) Filed: Apr. 28, 2006

(65) Prior Publication Data

US 2007/0251989 A1 Nov. 1, 2007

(51) Int. Cl.
*G06K 19/00* (2006.01)

(52) U.S. Cl. ..... 235/487

(58) Field of Classification Search ..... 235/487, 235/488, 489, 490; 463/16, 17; 273/139; 283/903, 102

See application file for complete search history.

(56) References Cited

U.S. PATENT DOCUMENTS 4,120,445 A * 10/1978 Carrier et al. ..... 206/459.1
4,787,950 A * 11/1988 Meloni et al. ..... 156/249
5,887,906 A 3/1999 Sultan
6,047,964 A 4/2000 Lawandy
6,270,406 B1 8/2001 Sultan
6,273,817 B1 * 8/2001 Sultan ..... 463/17
6,308,991 B1 10/2001 Royer
6,527,175 B1 3/2003 Dietz
6,736,324 B2 5/2004 Behm
6,875,105 B1 4/2005 Behm
2003/0216164 A1 11/2003 Scrymgeour
2004/0023711 A1 * 2/2004 Knapp ..... 463/17
2004/0227000 A1 * 11/2004 Behm et al. ..... 235/487

* cited by examiner

*Primary Examiner*—Michael G. Lee
*Assistant Examiner*—Paultep Savusdiphol
(74) *Attorney, Agent, or Firm*—Elliot Furman

(57) ABSTRACT

An anti-theft lottery ticket includes a substrate, a redemption bar code printed on one side of the substrate, and play symbols printed in a play area on one side of the substrate. The play area is covered with a scratch-off material and a destructible bar code is printed over a portion of the scratch-off material. The portion depends on whether the ticket is a winning ticket or a losing ticket. An enclosure encloses at least one anti-theft lottery ticket, and an activation bar code is attached to the enclosure. Anti-theft lottery ticket methods include scanning the activation bar code, the destructible bar code, and the redemption bar code by a retailer and communicating with an activation-validation database to determine if a lottery ticket is valid and payable.

11 Claims, 7 Drawing Sheets

ANTI-THEFT LOTTERY TICKET AND METHODS

BACKGROUND

Scratch-off lottery tickets ticket are extremely popular and are sold in magazine shops, grocery stores, convenience stores, and other types of shops and stores. In a typical scratch-off lottery game, a player purchases a ticket from a retailer and removes some or all of a scratch-off material covering a play area on the ticket to reveal numbers or symbol The scratch-off material is usually removed by scratching or rubbing it with a fingernail or edge of a coin. Depending on the rules of the particular instant lottery, the numbers or symbols indicate a winning ticket or a losing ticket. If the ticket is a winning ticket, the player presents the ticket to the retailer, who validates the ticket by scanning in a redemption bar code and/or by entering a validation or redemption number into a point of sale terminal. Once validated, the retailer pays the player the lottery winnings. If the ticket is a losing ticket, the ticket is worthless and the player usually discards it.

Scratch-off lottery ticket theft is a major problem faced by both lottery ticket suppliers and retailers. In one type of theft, a thief steals several scratch-off lottery tickets and removes the scratch-off material from all of the tickets to identify any winning tickets. Once identified, the thief returns to the retailer with the winning tickets. Since the retailer assumes that the tickets were purchased, the retailer pays the thief.

Some lottery tickets employ a validation bar code, a redemption bar code, or some other type of security code covered with a scratch-off material. The ticket is rendered void if the scratch-off material is removed by the player or anyone else, except the retailer. However, these security measures can be circumvented by a dishonest store clerk who cooperates with a thief to identify winning tickets and validate them, splitting the payout between them.

In another attempt to thwart theft, one or more lottery tickets are packaged together in a sealed plastic envelope or sleeve. A bar code, sometimes referred to in the art as a validation bar code, is printed on the plastic sleeve. The lottery prize for a winning ticket in the envelope is only payable after the bar code on the sleeve is scanned in at the time of purchase. Of course, a thief may tear open the sleeve without purchasing it and search for winning tickets. However, upon presenting the winning ticket to the retailer for payout, the ticket will not validate and thus cannot be redeemed as the envelope bar code was never scanned. That is, the ticket remains deactivated.

Not surprisingly, thieves have found a clever way around the envelope security measures; they carefully slice open the edge of the envelope with a razor blade and scratch off the tickets to determine if any of the tickets are winning tickets. Winning tickets are retained by thief. If necessary, in order to disguise the opened envelope, the thief places a ticket that has not been scratched off in the winning envelope. Then he purchase the envelope; the retailer is unaware that the envelope is open. Later, the thief returns to the retailer with the winning ticket which is successfully validated, and he collects his prize money.

Almost all of the prior art that is feasible for use in large scale distribution and sale of scratch-off lottery tickets share the same disadvantages, namely the bar code and packaging security measures, used alone or in combination, are easily thwarted by clever or bold thieves, crooked store clerks, or crafty razor work. And, other prior art that promises a solution to these outstanding problems require specialized equipment and systems, or are costly, or are generally incompatible with ticket sales and validation systems currently in use. Thus, a need presently exists for an anti-theft lottery ticket and methods.

SUMMARY

An anti-theft lottery ticket comprises a substrate having a first side and a second side. A redemption bar code is printed on one side of the substrate. The substrate includes a play area on one side of the substrate. A plurality of play symbols are printed in the play area. In a winning ticket at least some of the plurality of play symbols are winning play symbols. Covering the play area is a scratch-off material. A destructible bar code is printed over a portion of the scratch off material. If the anti-theft lottery ticket is a winning ticket, the portion that the destructible bar code is printed on covers at least one of the winning play symbols. If the anti-theft lottery ticked is not a winning ticket, the portion is a random portion of the scratch-off material. At least one anti-theft lottery ticket is stored in an enclosure. An activation bar code is attached to the enclosure. An anti-theft lottery ticket method for a lottery supplier includes receiving payment, shipping an enclosure, receiving an activation bar code, and activating destructible bar codes associated with the activation bar code. Further steps include, for each anti-theft lottery ticket, at the time of sale, receiving a destructible bar code, and activating a redemption bar code if the destructible bar code is activated. Additional steps include receiving the redemption bar code at the time of redemption, and transmitting a signal to a point of service terminal at a retailer depending on whether the redemption bar code is activated and whether the anti-theft lottery ticket is actually a winning ticket.

The foregoing paragraph has been provided by way of general introduction, and it should not be used to narrow the scope of the following claims. The preferred embodiments will now be described with reference to the attached drawings.

DETAILED DESCRIPTION OF THE PRESENTLY PREFERRED EMBODIMENTS

Figure 1A:
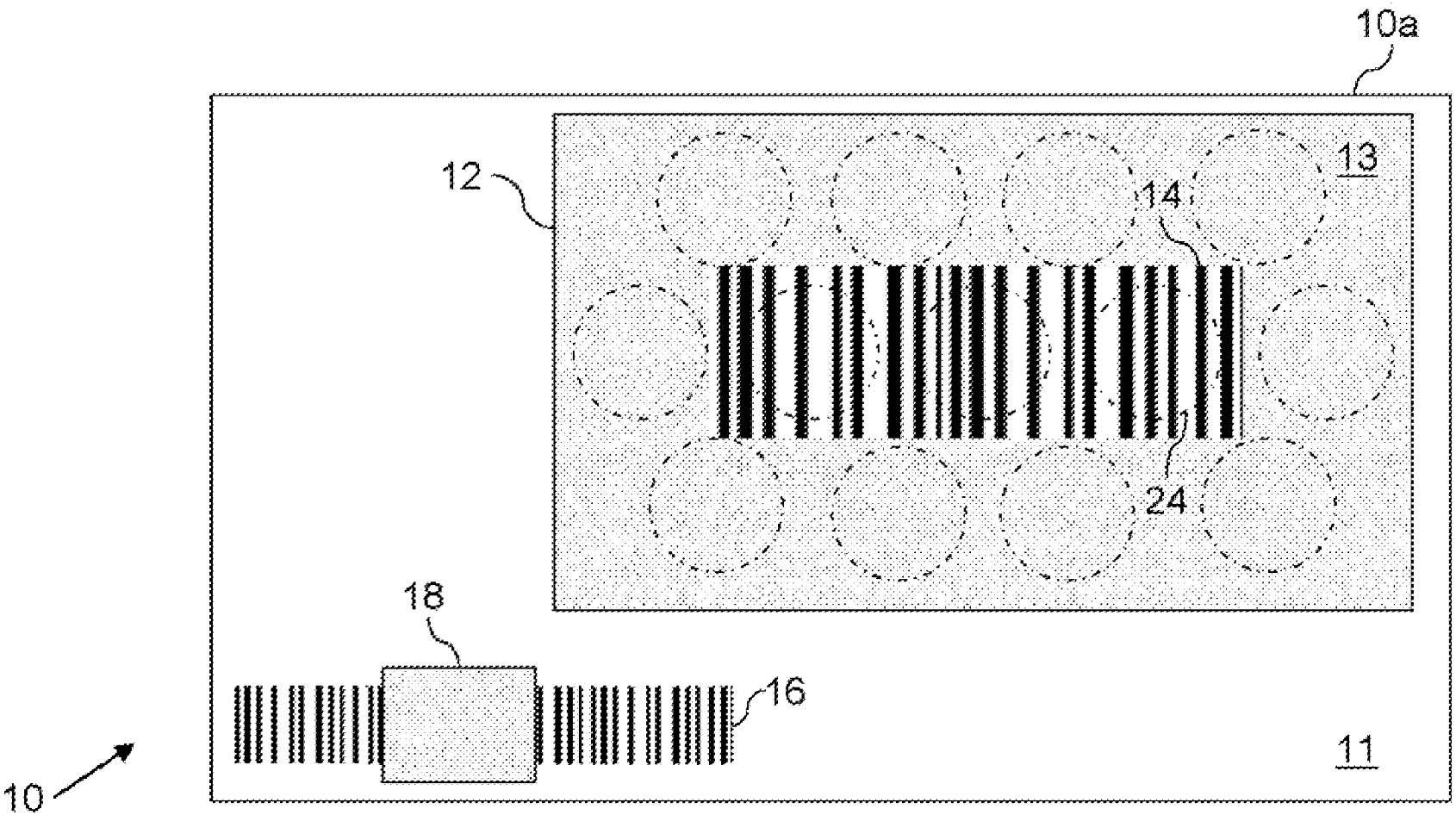
FIG. 1A is a plan view of a first side of an anti-theft lottery ticket comprising a play area covered with a scratch-off material and a destructible bar code printed over a portion of the scratch-off material.
Figure 1B:
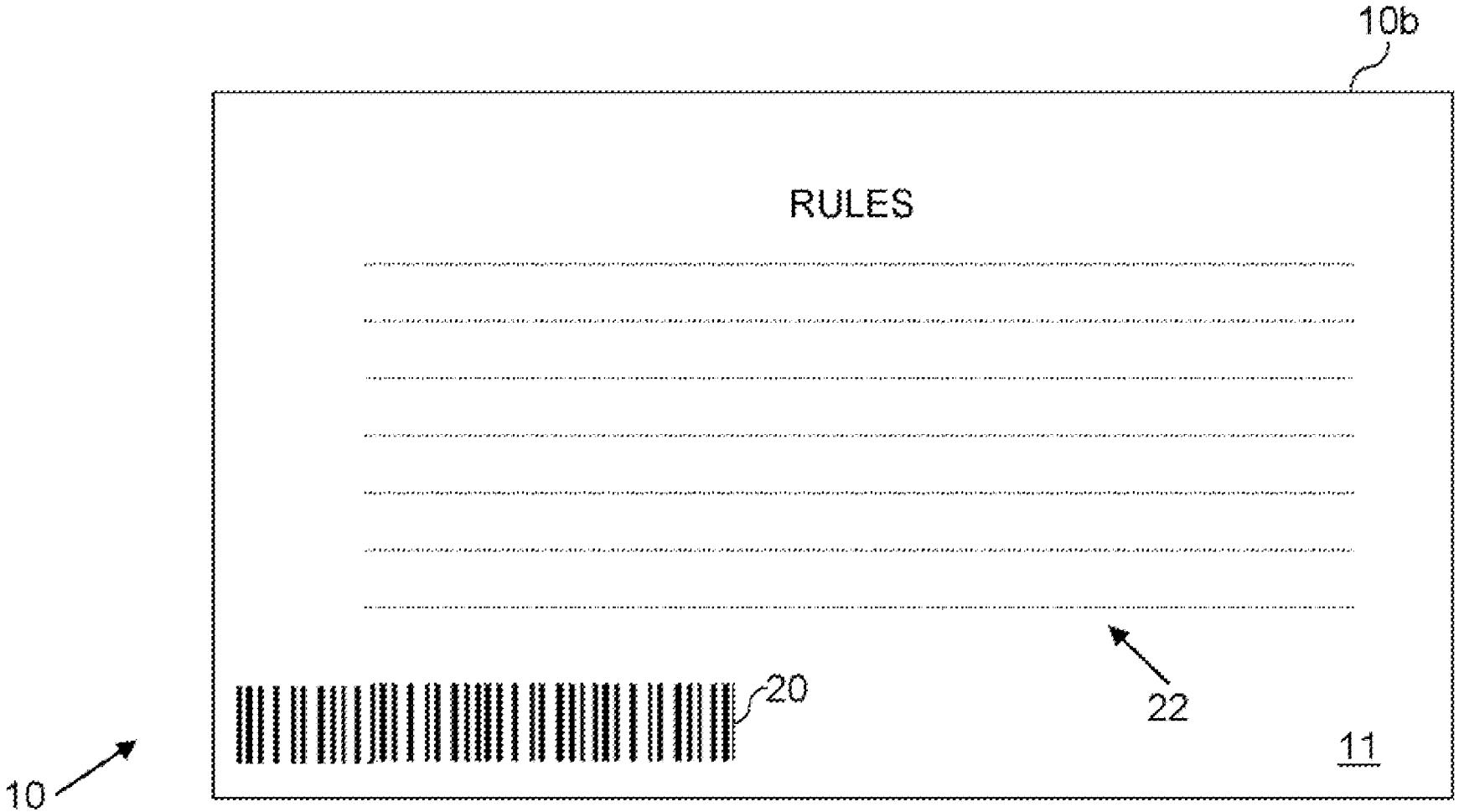
FIG. 1B is a plan view of a second side of an anti-theft lottery ticket.

FIGS. 1A and 1B shows a first side and a second side of an anti-theft lottery ticket 10. The anti-theft lottery ticket 10 is an instant-win scratch-off type lottery type game. As is well known to those of ordinary skill in the art, such lottery games have predetermined rules set by the lottery supplier when the lottery ticket is printed. On balance, most tickets are losing tickets and a small portion of tickets are winning ticket. A player scratches off some or all of the scratch-off material covering a play area to expose play symbols or other indicia. According to the predetermined rules, at least some of the play symbols of a winning ticket are winning play symbols. If the scratch-off material is removed for those symbols (and depending on the predetermined rules, only for those symbols) the player may redeem the ticket and collect the lottery prize money. For example, in one lottery game, the play symbols are words. A ticket is a winning ticket if four out of an exemplary eleven play symbols are the same word.

The anti-theft lottery ticket 10 comprises a substrate 11 having a first side 10*a* and a second side 10*b*. The substrate may be comprised of any material or combination of materials such as paper, cardboard, plastic, vinyl, acrylic, polyester, holographic paper, and other similar and well known materials commonly used as a substrate for lottery tickets. The substrate 11 of FIGS. 1A and 1B is shown rectangular but may be any shape and size suitable for lottery tickets, for example polygonal, rectilinear, curvilinear, or any combination thereof.

The anti-theft lottery ticket 10 further comprises a redemption bar code 20 printed on the second side 10*b*. The redemption bar code 20 may also be printed on the first side 10*a*, but is typically printed on what is considered "the back" of the lottery ticket in order to conserve space. Free space on the "front" is often used for eye-catching graphics and text designed to entice potential players. Either way, a redemption bar code or any other type of machine readable code may be printed on either side or both sides of the substrate 11, as is shown by exemplary machine readable code 16 and exemplary redemption bar code 20.

The anti-theft lottery ticket 10 also comprises a play area defined by rectangle 12. The play area may be any suitable shape. A plurality of play symbols (illustrated as dotted circles and not numbered except for play symbol 24) are printed in the play area 12. The play symbols are shown as circles and positioned in FIG. 1A merely for illustrative purposes, that is there may be a fewer or greater number of play symbols, they may be distributed in a different pattern within the play area 12, and the play symbols themselves may comprise an indicia or mark such as numbers, symbols, words, images, and the like. As is well known to those skilled in the art, the type of play symbols and their position relative to the play area 12 are printed in accordance with predetermined rules of the scratch-off game. It is appreciated that the present invention can be used with any conventional scratch-off type lottery game and the predetermined rules shall have no effect on the scope, usefulness, or novelty of the present invention.

Continuing with FIGS. 1A and 1B, a scratch-off material 13 covers the play area 12, thereby hiding the play symbols. The scratch-off material is typically an opaque material, such as a latex-based composition, that can be scraped off of the substrate 11 with the edge of a coin or a fingernail. FIG. 1A shows a single unbroken scratch-off material 13 covering the play area 12, but it is appreciated that the scratch off material may comprise several portions. For example, in one embodiment the scratch off material covers substantially only the play symbols, and not the empty space between the play symbols.

A destructible bar code 14 is printed over a portion of the scratch off material. The destructible bar code 14 is called "destructible" because the bar code is destroyed, that is it is removed or otherwise rendered unreadable by a machine, when a player scratches off some or all of the scratch-off material.

The position of the destructible bar code 14 is deliberately chosen: if the anti-theft lottery ticket is a winning ticket, the destructible bar code 14 is printed at a position on the scratch-off material covering at least one winning play symbol; if the anti-theft lottery ticket is not a winning ticket, the destructible bar code 14 is printed at a random position on the scratch-off material. Printing, or otherwise forming or attaching, the destructible barcode in these positions makes it impossible to determine if a ticket is a winning ticket or a losing ticket by studying the position of the destructible bar code. Furthermore, if the ticket is a winning ticket, the destructible bar code is necessarily removed or destroyed by the player. For example, lottery ticket 10 of FIG. 1A is a winning ticket, and play symbol 24 is a winning symbol. Thus, the destructible bar code 14 is printed such that it completely covers the scratch-off material covering the winning play symbol 24. The destructible bar code may optionally partially or fully cover other play symbols, whether they are winning play symbols or not.

The destructible bar code, the redemption bar code, and all other bar codes of the present invention may be a one-dimensional bar code, a two-dimensional bar code, or any other machine readable code. It is well understood by those skilled in the art that different bar codes have different properties. For example, some bar codes encode in them a large amount of error correcting information, and are therefore more resistant to damage, that is they can still be reliably read by a scanner even if they are partially obscured or damaged in some way. In one embodiment the destructible bar code 14 is designed to be very sensitive to damage, that is, it cannot be scanned or read by a machine if even a small portion is removed or scratched-off. But, the redemption bar code 20, and any other bar code such as exemplary bar code 16, and an activation barcode (which will be discussed below) is designed to have more significant error correction properties. U.S. Pat. No. 6,736,324 discusses lottery ticket bar codes and is hereby incorporated by reference.

As already mentioned, FIG. 1A shows exemplary bar code 16. Bar code 16 may be a redemption bar code, or any other type of bar code such as an inventory bar code. The bar code may also have multiple uses, such as for redemption, validation, inventory, and sales tracking. In one embodiment, bar code 16 is at least partially covered by a second scratch-off material 18. The second scratch-off material may have words, symbols, or indicia printed on it such as "Void if removed." It is also noted that a second, or even several more destructible bar codes can be printed over different portions of the scratch-off material 13 of the play area 12.

Side 10*a* of substrate 11 may also comprise information such as instructions, decorative graphics, or advertising. These are not shown, but it is common in the art to print such information on the area of the substrate not occupied by the play area, bar codes, or scratch-off material. Further illustrating other possibilities, FIG. 1B shows text 22 printed on the second side, that is the "back" of the ticket. Typically, text 22 comprises instructions for playing the lottery game and the rules of the lottery game.

Figure 2:
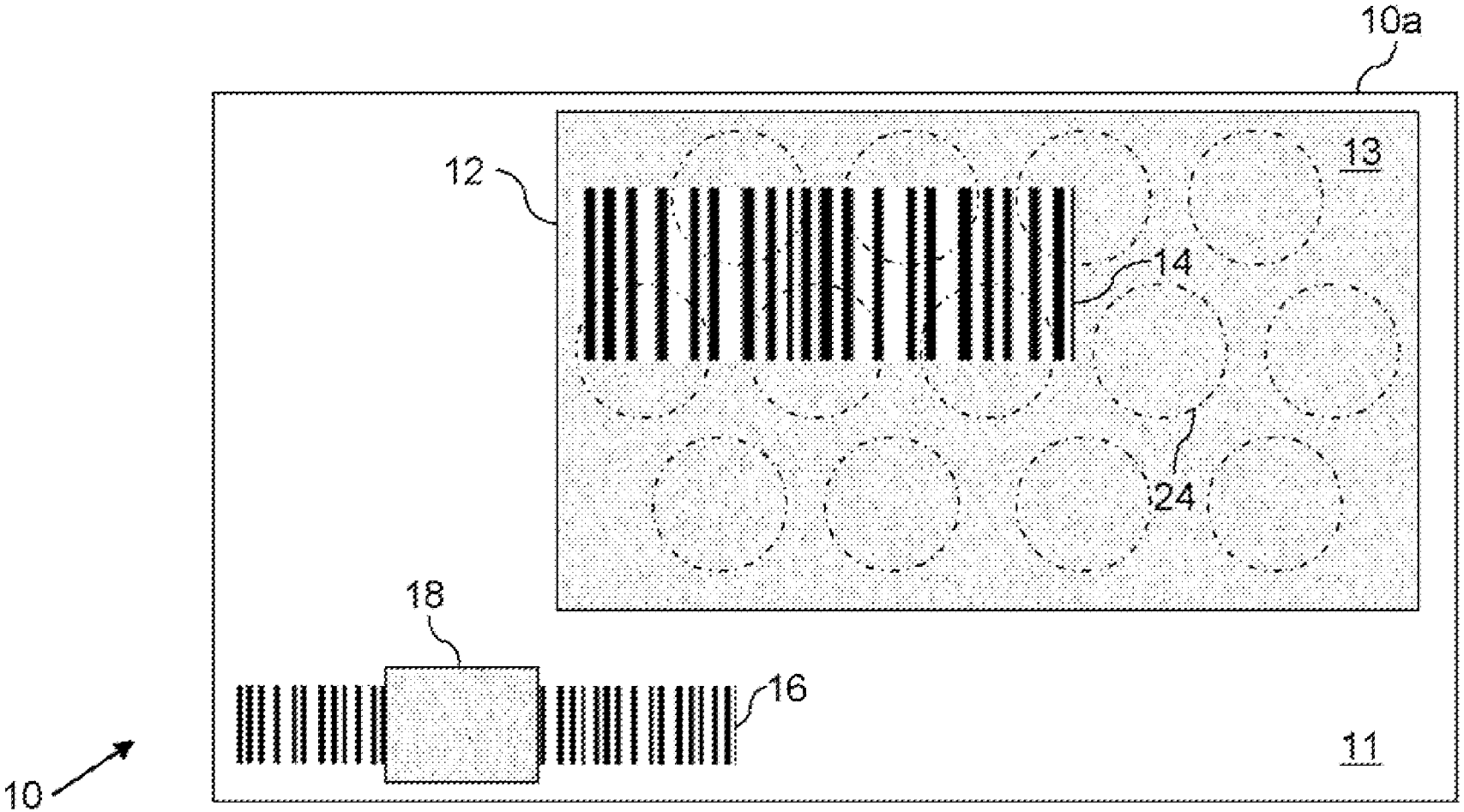
FIG. 2 is a plan view of an anti-theft lottery ticket showing the play area and the destructible bar code in a different position.

FIG. 2 shows an anti-theft lottery ticket 10 for the same lottery game as the ticket of FIG. 1A, however the destructible bar code 14 is printed over a different portion of the scratch-off material 13 of the play area 12. If lottery ticket 10 of FIG. 2 is a losing ticket then destructible bar code 14 is randomly positioned in play area 12. If it is a winning ticket then destructible bar code 14 is printed entirely over at least one winning play symbol beneath the scratch-off material.

Figure 3:
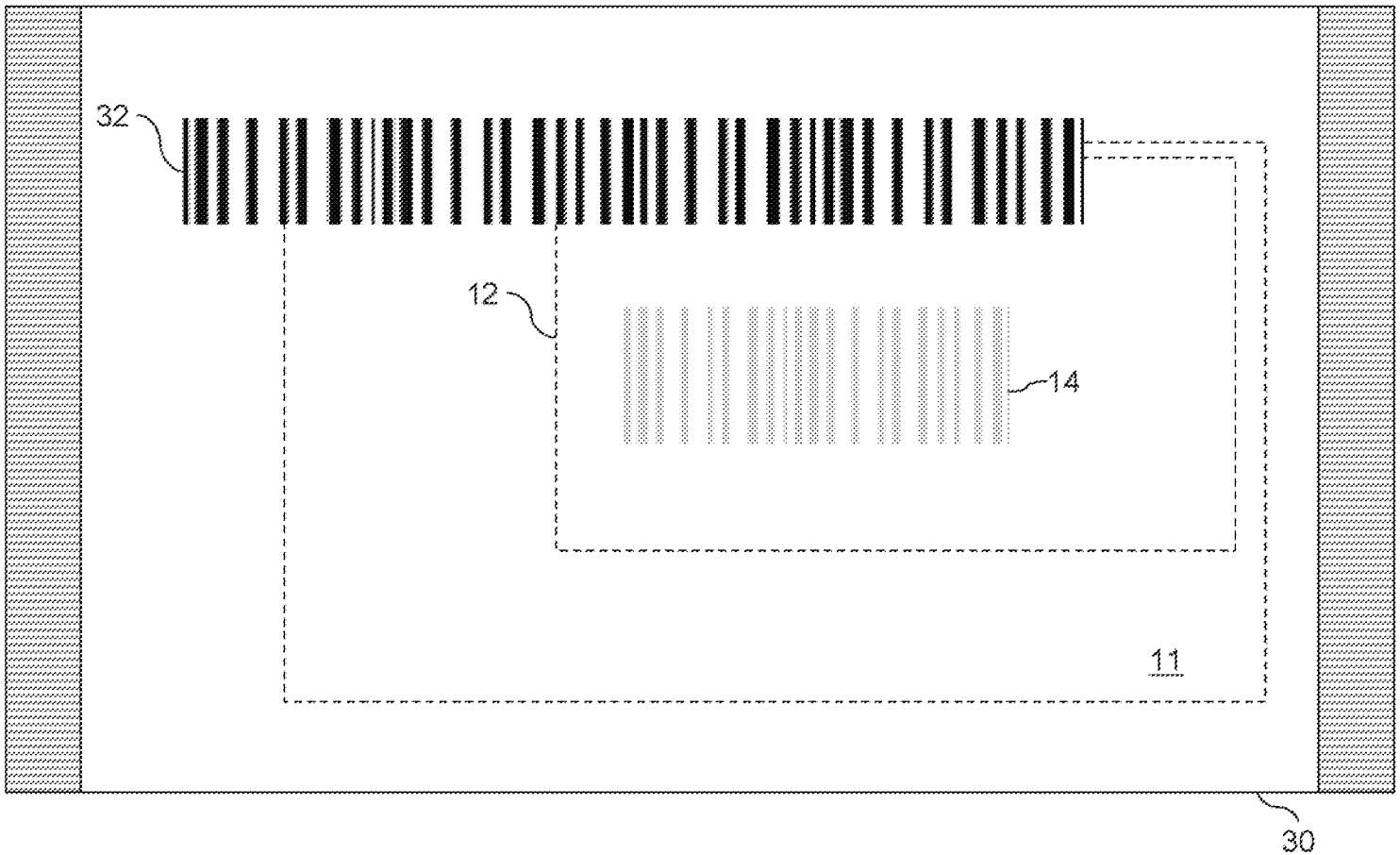
FIG. 3 is a plan view of at least one anti-theft lottery ticket packaged in an enclosure.

FIG. 3 shows a plan view of at least one anti-theft lottery ticket packaged in an enclosure 30. The enclosure 30 is typically used to sell and ship multiple lottery tickets to a retailer in a single convenient package. In one embodiment there are ten lottery tickets per enclosure. Examining FIG. 3, at least one anti-theft lottery ticket is stored in enclosure 30. An activation bar code 32 is printed on the enclosure. In one embodiment, the enclosure is a sealed envelope or sleeve made of plastic, vinyl, or acrylic. Other enclosures may be used such as paper or cardboard envelopes or sleeves, or boxes. The enclosure may comprise any of a number of tamper resistant feature commonly employed in the art.

Figure 4A:
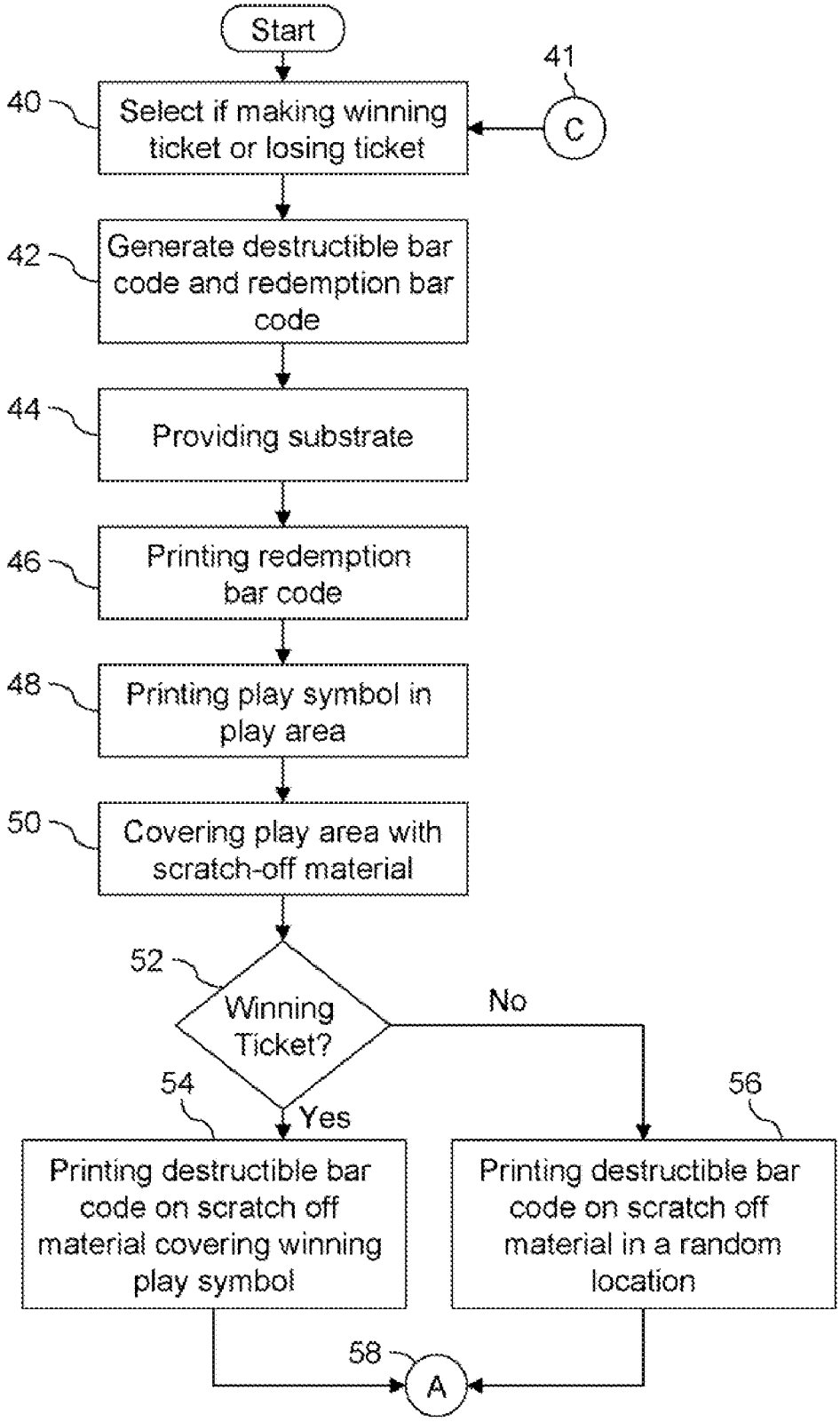
FIGS. 4A and 4B show a method for making anti-theft lottery tickets and an activation-validation database.
Figure 4B:
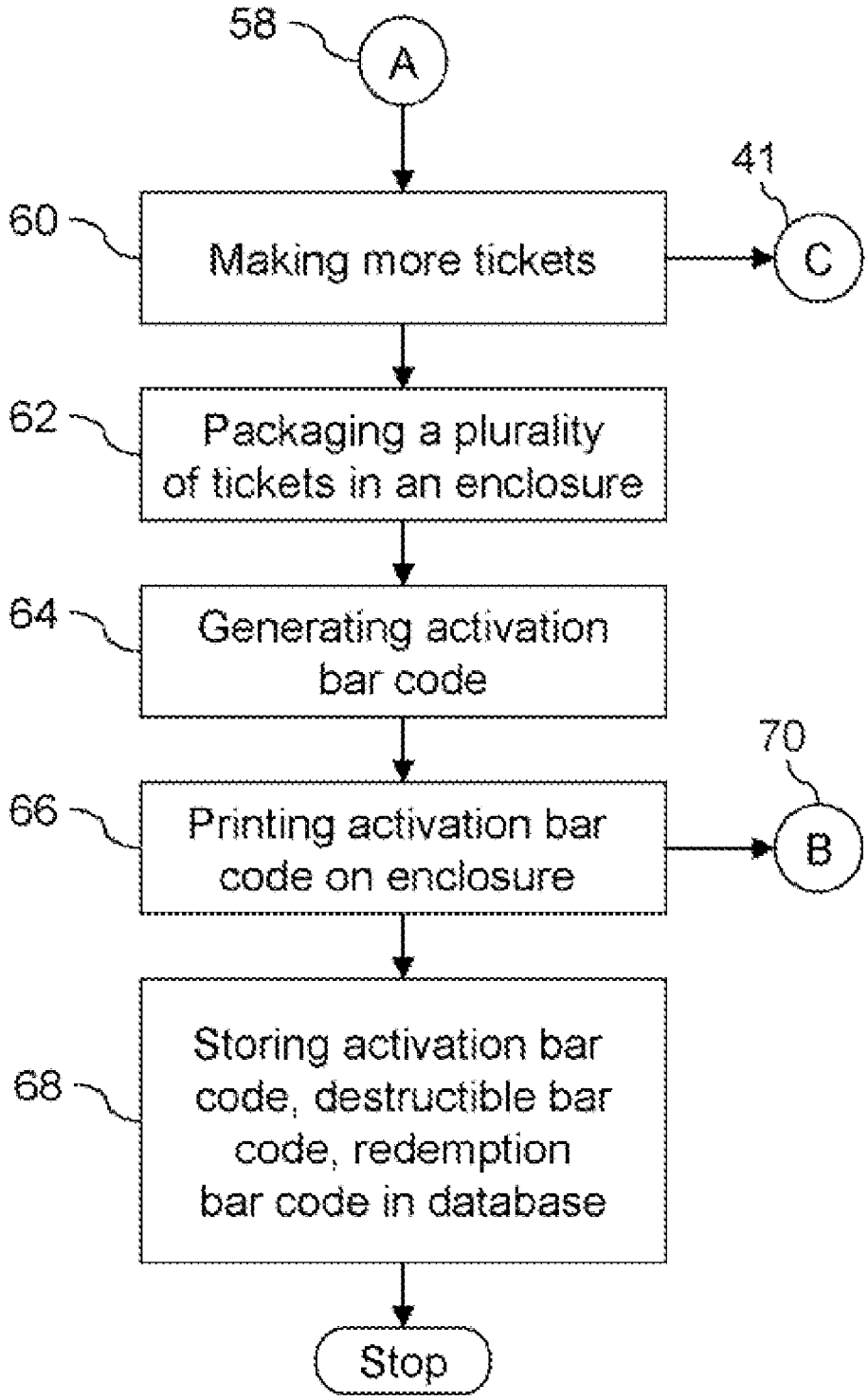

FIGS. 4A and 4B show a method for making anti-theft lottery tickets and an activation-validation database. Typically, lottery tickets are printed by computer controlled printers. The computer and printers can be programmed to print any number of lottery tickets, having various game play symbols, various winning ticket to losing ticket ratios, various bar codes, various play areas, various scratch-off materials, and the like. Such computer controlled printers are widely used for lottery ticket manufacturing and are well understood.

Referring to FIG. 4A, a method for making an anti-theft lottery ticket is shown. According to predetermined rules of a scratch-off lottery ticket game, a selection is made as to whether the ticket to be made will be a winning ticket or a losing ticket (step 40). This is a purely mathematical decision based on the payout the lottery supplier desires to realize. A destructible bar code and a redemption bar code are generated (step 42). By "generated" it is meant that a computer creates a digital code, or a sequence of numbers, in compliance with one of any number of bar code standards. The digital code can be printed in bar code form using well established methods, and the bar code can later be scanned or read by a scanner to recall the digital code.

A substrate is provided (step 44) having a first side and a second side. The redemption bar code is printed (step 46) on one side of the substrate. Also, a plurality of play symbols are printed in the play area (step 48) in accordance with the predetermined rules. If the anti-theft lottery ticket was selected as a winning ticket (in step 40) then at least some of the plurality of play symbols are winning play symbols.

After printing the plurality of play symbols, the play area is covered with a scratch-off material (step 50). Next, if the anti-theft lottery ticket is a winning ticket (step 52), the destructive bar code is printed over a portion of the scratch-off material that covers at least one of the winning play symbols (step 54). Or, if the anti-theft lottery is a losing ticket (step 52), the destructible bar code is printed over a random portion of the scratch-off material (step 56). The method of FIG. 4A is repeated to make a plurality of tickets.

Referring to FIG. 4B, multiple tickets are made, packaged in an enclosure, and bar codes are added to a database. More tickets are made (step 60) by repeating steps 40, 42, 44, 46, 48, 50, 52, 54, and 56. Then, a plurality of tickets are packaged in an enclosure (step 62). Automated packaging machines are widely used in many industries, and are well understood. An activation bar code is generated (step 64), and the activation bar code is printed on the enclosure (step 66). In an alternate embodiment, the activation bar code is printed on a substrate and the substrate is packaged in the enclosure. For example, the enclosure may be a clear plastic sleeve containing ten lottery tickets and a cardboard substrate printed with the activation barcode. The activation barcode is viewable or scanable through the enclosure. In any case, "printing" on the enclosure is understood to mean and shall have the same effect as printing on a substrate located within the enclosure; an activation barcode is attached either directly or indirectly to the enclosure.

The activation bar code, the destructible bar code for each of the plurality of anti-theft lottery tickets, and the redemption bar code for each of the plurality of anti-theft lottery tickets are stored in electronic form in an activation-validation database (step 68). The activation-validation database resides on a computer. The computer is connected to a telecommunications network so that point of sale terminals can communicate with the computer. The computer may be any conventional computer, such as an Intel or Intel compatible based computer running any conventional operating system such as Microsoft Windows or any version of Linux. The database may be any conventional database such as a Microsoft Access database or an SQL database. These components of the computer, including creating, storing, modifying, and querying databases are well understood by those of ordinary skill in the art. The telecommunications network may be the Internet, or any other type of network, such as a wide area network, a wireless network, or any type of public or private network. Encryption may be used when communicating over the telecommunications network. Any conventional or industry standard form of encryption may be used such as Secure Sockets Layer (SSL), HTTPS, passwords, digital certificates, and Kerberos tickets.

The activation-validation database comprises a master index of all of the anti-theft lottery tickets that have been made, activated, bought, sold, and redeemed. For example, for one enclosure holding five anti-theft lottery tickets, the database links the destructive bar code for each of the five tickets to the activation bar code. For each anti-theft lottery ticket, the database also links the destructive bar code to the redemption bar code. And, the database stores activation data, that is, data indicating whether a particular bar code has been activated.

The database, in communication with a point of sale terminal commonly found at retail locations, ensures that several events must occur before a retailer pays a lottery prize to a player for a winning ticket. Specifically, the retailer must purchase an enclosure of anti-theft lottery tickets thereby activating the activation bar code; the destructive bar code must be activated by scanning the activation bar code; the redemption bar code must be activated by scanning the destructive bar code; the destructive bar code must be destroyed to reveal a winning ticket; and the redemption bar code must be scanned to verify the validity of the winning ticket. Only after all of these events occur will a retailer be permitted to pay a player.

By only allowing payment of a winning ticket after these events have occurred in the specified order, ticket theft is thwarted. Stealing the enclosure of tickets before scanning of the activation bar code, either before or after the enclosure is purchased, ensures that none of the destructive bar codes are activated for any of the tickets stored in the enclosure. But, removing the scratch-off material to find a winning ticket necessarily destroys the destructive bar code. With the destructive bar code destroyed, the redemption bar code can never be activated, and payout will never occur.

Stealing tickets after the activation bar code has been scanned will similarly not result in payout. In this case, although the destructive bar code is activated by scanning of the activation bar code, the thief does not pay for the ticket, so the destructive bar code is never scanned at the point of sale terminal to activate the redemption bar code. But, in order to find a winning ticket, the thief must necessarily destroy the destructive bar code of the winning ticket, thereby preventing any possible activation of the redemption bar code.

Of course, a thief may try to cooperate with a dishonest store clerk. In this scenario the dishonest store clerk scans in the destructive bar codes to activate the redemption bar code without paying, and then the thief removes the destructive bar codes to locate any winning tickets. This is impractical since each destructible bar code of every ticket must scanned, that is, a false sale must be made before the ticket can be scratched off. The likelihood of getting caught "in the act" is high and the potential payout is low—a thief has to go through many tickets to find a winner.

Furthermore, as discussed above, a bar code such as an inventory bar code can be used by the retailer to track and monitor ticket sales. In one embodiment, the destructive bar code also contains inventory data so a retailer knows within a very short time if fake purchases are occurring, evidenced by the fact that the tickets are "sold" according to inventory, but there is no money to account for the sale. In this embodiment, it is very easy for the retailer to quickly locate the dishonest store clerk and terminate his job. So, even if a thief/store clerk operation is successful at first, it is easily and quickly shut down, and the thief and store clerk apprehended.

Figure 5:
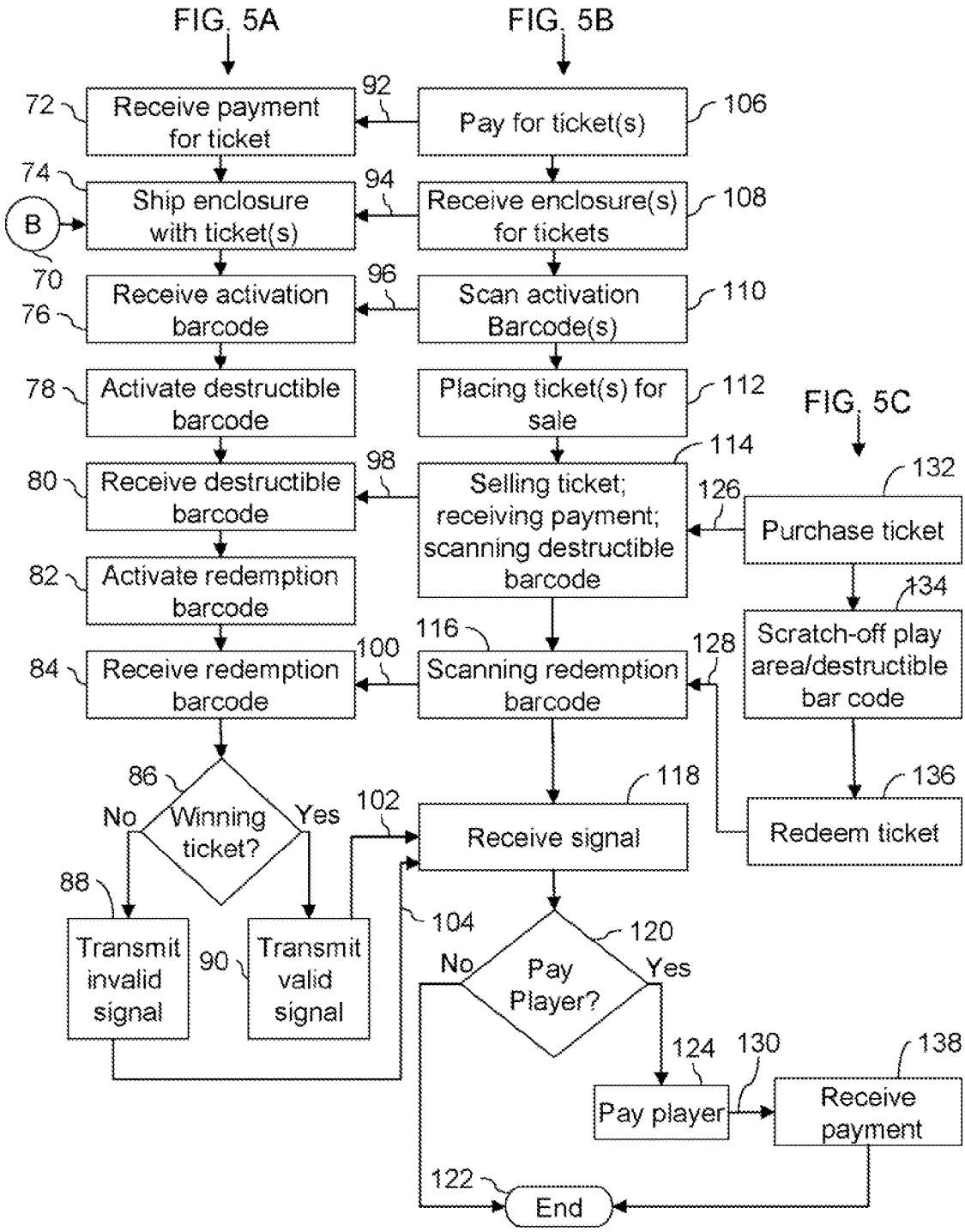
FIG. 5A shows an anti-theft lottery ticket method for a lottery supplier.
FIG. 5B shows an anti-theft lottery ticket method for a retailer.
FIG. 5C shows an anti-theft lottery ticket method for a player.

Now turning to FIGS. 5A, 5B, and 5C, anti-theft lottery ticket methods are shown. FIG. 5A shows an anti-theft lottery ticket method for the lottery supplier. Payment is received (92) for anti-theft lottery tickets (step 72). An enclosure (or several enclosures) enclosing anti-theft lottery tickets is shipped (94) to a retail location (step 74). Recall, from FIG. 4B, the enclosure, tickets, and database are created and the enclosure is ready for shipping (70).

Next, an activation bar code is received (step 76), and each destructible bar code associated with the activation bar code is activated (step 78). This occurs after the retailer receives the enclosure(s) and scans the activation bar code(s), as will be discussed below. Note that each destructible bar code belongs to a ticket in the enclosure that was shipped in step 74.

Then, for each ticket, at the time of the sale of the ticket at the retailer, a destructible bar code is received (step 80). This activates the redemption bar code (step 82). At the time of redemption, that is after a player has played the lottery ticket (134) and attempts to redeem it (136), the redemption bar code is received (step 84). The redemption bar code is validated to determine if payout should be permitted (step 86).

If the received redemption bar code is activated and is for a winning ticket, a signal is transmitted (step 90) to the point of sale terminal located at the retail location to indicate that a lottery prize should be paid. The signal may also cause the point of sale terminal to display the amount of the payout and various other data. Otherwise, if the received bar code is not activated or is not for a winning ticket, a signal is transmitted to cause the point of sale terminal to indicate that the ticket is invalid and no money should be paid (step 88).

FIG. 5B shows an anti-theft lottery ticket method for a retailer. The retailer pays the lottery supplier for ticket(s) (step 106). After payment, an enclosure(s) is received enclosing anti-theft lottery ticket(s) (step 108). Next, the activation bar code(s) of the enclosure(s) are scanned at a point of sale terminal, and the activation bar code(s) are transmitted to the computer storing the activation-validation database (step 110). At this point, recalling from above, all destructible bar codes associated with the scanned activation bar code(s) are activated (step 78 of FIG. 5A).

The retailer places the anti-theft lottery ticket(s) for sale (step 112). Then, for each anti-theft lottery ticket(s) placed for sale, at the time of sale (step 132 of FIG. 5C), payment is received (126) and the destructible bar code is transmitted to the computer storing the activation-validation database (step 114). Also, as already discussed above, the retailer may also scan an inventory bar code to track the sale internal to the retail outlet. In one embodiment, the destructible bar code also comprises inventory bar code data for use by the retailer.

At the time of redemption, that is after the player has played the lottery ticket by removing the destructible bar code (step 134 of FIG. 5C) and attempts to redeem the ticket (step 136 of FIG. 5C), the redemption bar code is scanned at the point of sale terminal and the redemption bar code is transmitted to the computer storing the activation-validation database (step 116).

Next, a signal is received at the point of sale terminal (step 118) causing the point of sale terminal to indicate whether or not the player should be paid the lottery prize (step 120). If the point of sale terminal indicates payment, the player is paid (step 124), otherwise, the player is not paid (step 122).

FIG. 5C shows an anti-theft lottery ticket method for a player. From the player's point of view, nothing changes in comparison to the way he plays many of his favorite lottery ticket games. The player purchases a ticket (step 132), removes the scratch-off material from the play area, and in the doing so destroys the destructive bar code (step 134). If the player thinks he has a winning ticket he redeems the ticket (136). And if the ticket is valid, the player receives payment (step 133).

Those skilled in the art will appreciate that the term "printing" includes not only printing with inks or dyes through the application of pressure and other means, but also photographic imaging, chemical imaging, electrostatic imaging, sputtering, thermo-imaging, thermoelectric imaging, and the like. "Printing" also includes printing on an intermediate substrate and affixing the intermediate substrate to the anti-theft lottery ticket substrate or the scratch-off material. For example, in one embodiment the destructible bar code is printed on a destructible decal or sticker, and the destructible decal or sticker is affixed to the scratch-off material covering the play area. Destructible decals or stickers may be comprised of many different materials such as acrylic, vinyl, or polyester, and include an adhesive on one side. Once attached to a surface, and sometimes after a cure time, the sticker becomes impossible to remove without destroying it; the sticker tears into many small pieces. Destructible decals and stickers are commercially available from a multitude of companies and are well understood in the art.

The foregoing detailed description has discussed only a few of the many forms that this invention can take. It is intended that the foregoing detailed description be understood as an illustration of selected forms that the invention can take and not as a definition of the invention. It is only the following claims, including all equivalents, that are intended to define the scope of this invention.

What is claimed is:

1. An anti-theft lottery ticket comprising:

a substrate having a first side and second side;

a redemption bar code printed on one side of said substrate;

a play area on one side of said substrate;

a plurality of play symbols printed in said play area wherein if the anti-theft lottery ticket is a winning ticket at least some of said plurality of play symbols comprise winning play symbols;

a scratch-off material covering said play area; and a destructible bar code printed over a portion of said scratch-off material;

wherein if the anti-theft lottery ticket is a winning ticket, said destructible bar code printed over the portion of said scratch-off material covers at least one of said winning play symbols printed in said play area;

wherein if the anti-theft lottery ticket is not a winning ticket, said destructible bar code printed over the portion of said scratch-off material covers a random portion of said scratch-off material covering said play area; and wherein said destructible bar code is operative to activate said redemption bar code.

2. The invention of claim 1 wherein said destructible bar code and said redemption bar code is either a one-dimensional bar code or a two-dimensional bar code.

3. The invention of claim 1 wherein said redemption bar code is at least partially covered by a second scratch-off material.

4. The invention of claim 1 further comprising a second destructible bar code printed over a second portion of said scratch-off material.

5. The invention of claim 1 further comprising at least one of the following printed on said substrate: a numerical security code, a machine readable code, text, decorative graphics, and advertising.

6. An anti-theft lottery tickets comprising:

an enclosure;

an activation bar code attached to said enclosure;

at least one anti-theft lottery ticket stored in said enclosure, said at least one anti-theft lottery ticket comprising, a substrate having a first side and second side;

a redemption bar code printed on one side of said substrate;

a play area on one side of said substrate;

a plurality of play symbols printed in said play area wherein if the anti-theft lottery ticket is a winning ticket at least some of said plurality of play symbols comprise winning play symbols;

a scratch-off material covering said play area; and a destructible bar code printed over a portion of said scratch-off material;

wherein if the anti-theft lottery ticket is a winning ticket, said destructible bar code printed over the portion of said scratch-off material covers at least one of said winning play symbols printed in said play area;

wherein if the anti-theft lottery ticket is not a winning ticket, said destructible bar code printed over the portion of said scratch-off material covers a random portion of said scratch-off material covering said play area;

wherein said activation bar code is operative to activate said destructible barcode and said destructible barcode is operative to activate said redemption barcode.

7. The invention of claim 6 wherein said enclosure comprises a sealed envelope.

8. A method for making an anti-theft lottery ticket and an activation-validation database comprising the steps of:

(a) according to predetermined rules of a scratch-off lottery ticket game, selecting if the anti-theft lottery ticket is a winning ticket or a losing ticket;

(b) generating a destructible bar code and a redemption bar code for the anti-theft lottery ticket, wherein the destructible bar code is operative to activate the redemption bar code;

(c) providing a substrate having a first side and second side;

(d) printing the redemption bar code on one side of the substrate;

(e) printing a plurality of play symbols in a play area on one side of the substrate in accordance with the predetermined rules, wherein if the anti-theft lottery ticket is a winning ticket at least some of the plurality of play symbols are winning play symbols in accordance with the pre-determined rules;

(f) covering the play area with a scratch-off material;

(g) if the anti-theft lottery ticket is a winning ticket, printing the destructible bar code over a portion of the scratch-off material that covers at least one of the winning play symbols printed in the play area; and (h) if the anti-theft lottery ticket is a losing ticket, printing the destructible bar code over a random portion of the scratch-off material covering the play area.

9. The method of claim 8 further comprising the steps of:

(i) making a plurality of anti-theft lottery tickets by repeating the steps of (a) through (h);

(j) packaging the plurality of anti-theft lottery tickets in an enclosure;

(k) generating an activation bar code wherein the activation bar code is operative to activate the destructible bar code of each of the plurality of anti-theft lottery tickets; and (l) attaching the activation bar code to the enclosure.

10. The method of claim 9 further comprising the step of:

(m) storing in electronic form in an activation-validation database on a computer the activation bar code, the destructible bar code on each of the plurality of anti-theft lottery tickets, and the redemption bar code on each of the plurality of anti-theft lottery tickets, such that a winning ticket is payable only after, and in the following order, the activation bar code of the plurality of anti-theft lottery tickets is activated, the destructible bar code of each of the plurality of anti-theft lottery tickets is activated, and the redemption bar code of the winning ticket of the plurality of anti-theft lottery tickets is activated.

11. The method of claim 10 further comprising the step of making a plurality of enclosures enclosing anti-theft lottery tickets by repeating the steps of (a) through (m).

* * * * *